US006027086A

United States Patent [19]

Heitlinger et al.

[11] Patent Number: 6,027,086

[45] Date of Patent: Feb. 22, 2000

[54] FOOT OF A PIECE OF FURNITURE OR SUPPORT

[75] Inventors: Karl-Leo Heitlinger, Tannenweg 9, D-73525 Schwäb. Gmünd, Germany; Alexander Strebelow, Schwäb. Gmünd, Germany

[73] Assignee: Karl-Leo Heitlinger, Schwäb.Gmünd, Germany

[21] Appl. No.: 09/035,514

[22] Filed: Mar. 5, 1998

[30] Foreign Application Priority Data

Mar. 10, 1997 [DE] Germany ..... 197 09 782

[51] Int. Cl.[7] ..... F16M 11/26

[52] U.S. Cl. ..... 248/188.5; 248/188.8; 248/411

[58] Field of Search ..... 248/685, 649, 248/188.8, 411, 407, 412, 414, 188.5, 188.2, 188.1

[56] References Cited

U.S. PATENT DOCUMENTS

| | | | |
|---|---|---|---|
| 1,556,735 | 10/1925 | Tiffany | 248/188.2 X |
| 2,388,056 | 10/1945 | Hendricks | 248/407 X |
| 2,705,119 | 3/1955 | Ingwer | 248/412 X |
| 3,153,123 | 10/1964 | Harman | 248/414 |
| 3,424,111 | 1/1969 | Maslow | 248/412 X |
| 3,662,428 | 5/1972 | Koehl | 348/188.8 X |
| 4,442,993 | 4/1984 | Tseng | 248/412 X |
| 5,490,648 | 2/1996 | Cullen | 248/185.5 X |
| 5,678,892 | 10/1997 | Heitlinger | 248/188.5 X |
| 5,762,303 | 6/1998 | Chae | 248/649 X |

FOREIGN PATENT DOCUMENTS 4441605 3/1996 Germany .

*Primary Examiner*—Derek J. Berger
*Attorney, Agent, or Firm*—Pauley Petersen Kinne & Fejer

[57] ABSTRACT

An adjustable foot of a piece of furniture or support, having an adjusting arrangement formed from an internal adjusting part and a sleeve element displaceably mounted on the internal adjusting part. With a simple structure, a multiple variability of the foot of a piece of furniture or support is possible when the sleeve element is configured as a connector element, the outer surface of which is adapted to the internal diameter of an external profile for insertion into the external profile and has an abutment, on which the external profile is supported in the inserted position.

12 Claims, 1 Drawing Sheet

FOOT OF A PIECE OF FURNITURE OR SUPPORT

BACKGROUND OF THE INVENTION

1. Field of the Invention

This invention relates to an adjustable foot of a piece of furniture or support, having an internal adjusting part, which is disposed on a lower end of the foot or support and has on its outer surface a plurality of annular grooves, which are spaced from one another when viewed with respect to an axial direction, a resilient ring which is insertable in the grooves and, in the inserted position, protrudes with an outer surface beyond an external periphery of the adjusting part, and has a sleeve-like element which can be slidably slipped over the adjusting part as far as the ring and has on a side facing the ring a widened portion, which is adapted to a protruding region of the element, for clampingly gripping over the ring.

2. Description of Prior Art

A conventional foot of a piece of furniture or support is disclosed in German Patent Reference DE 44 41 605 C2. In this known foot of a piece of furniture or support, one leg portion is configured as an outer part, and the other leg portion is configured as an inner part, which is telescopically displaceable relative to the outer part. The outer part is supported on the inner part by the ring and the clamping widened portion, which surrounds said ring.

SUMMARY OF THE INVENTION

One object of this invention is to provide an adjustable foot of a piece of furniture or support of the initially mentioned type, which easily renders possible various external configurations.

According to this invention, an adjustable foot of a piece of furniture or support, having an internal adjusting part, is disposed on a lower end of the foot or support and has on its outer surface a plurality of annular grooves, which are spaced from one another when viewed with respect to an axial direction. A resilient ring is insertable in the grooves and in an inserted position, protrudes with an outer surface beyond the external periphery of the adjusting part. A sleeve-like element can be slidingly slipped over the adjusting part as far as the ring and has on its side facing the ring a widened portion, which is adapted to the protruding region of the element, for clampingly gripping over the ring. The sleeve-like element is configured as a connector element, the outer surface of which is adapted to the internal diameter of an external profile for insertion into the external profile and has an abutment, on which an external profile is supported in the inserted position.

Accordingly, the sleeve-like element is configured as a connector element, the outer surface of which is adapted to the internal diameter of an external profile for insertion into the external profile and has an abutment, on which the external profile is supported in the inserted position. Because the sleeve-like element is configured as a connector element, over which the external profile is easily slipped, and on which it is supported in a stable manner, it is easy to produce quite different external profiles with the vertical adjustment via the connector element. The external profile itself may be formed from suitable material and in the desired external design and only needs to be deflected in accordance with the desired height for the foot of the piece of furniture or support.

An advantageous way of applying the vertical adjustment to the external profile resides in the fact that the adjusting part, together with the connector element, is inserted into the lower end of the external profile. Also, the abutment is configured as a stop collar, the external configuration of which is adapted to the external configuration of the external profile.

The connector element is retained in the external profile in a stable manner when the outer surface of the portion of the connector element protruding into the external profile has a profiling for non-slip retention in the external profile. In such case, the profiling may comprise annular ribs, which are inclined when viewed with respect to a direction of insertion and are orientated in opposition to the direction of insertion.

The connector element can easily be prevented from accidental removal from the adjusting part, because the adjusting part also protrudes beyond the connector element with an internal portion which likewise has one or more annular grooves, into which a guard ring is inserted, which protrudes beyond the external periphery of the adjusting part. The vertical adjustment with the adjusting part and the connector element can then easily be inserted into the external profile. If the guard ring is supported with its external circumference on the internal periphery of the external profile, the guard ring also helps provide support relative to the external profile and provides stability.

An additional possible variant for the foot of a piece of furniture or support is rendered possible when a receiving means for mounting an end trim is in the lower end face of the adjusting part. In such case, the end trim may be shaped as a simple element in various forms, e.g. even as a castor, whereby the visual appearance can vary greatly. In such case, the end trim may be used at the same time for fine adjustment if the receiving means is configured as a bore extending in the axial direction, and for the end trim to have a securing pin, which can be secured in the bore.

A good holder for the adjusting part in the external profile can also be provided when the adjusting part protrudes beyond the connector element with an internal portion, on which a collar or bead is moulded, wherein the collar or bead being adapted to the internal periphery of the external profile, and when the internal portion has at its free end an elongated slot, which extends beyond the location of the collar or bead.

BRIEF DESCRIPTION OF THE DRAWINGS

This invention is explained more fully with reference to the drawing of one embodiment, wherein.

DESCRIPTION OF PREFERRED EMBODIMENTS

Figure 1A:
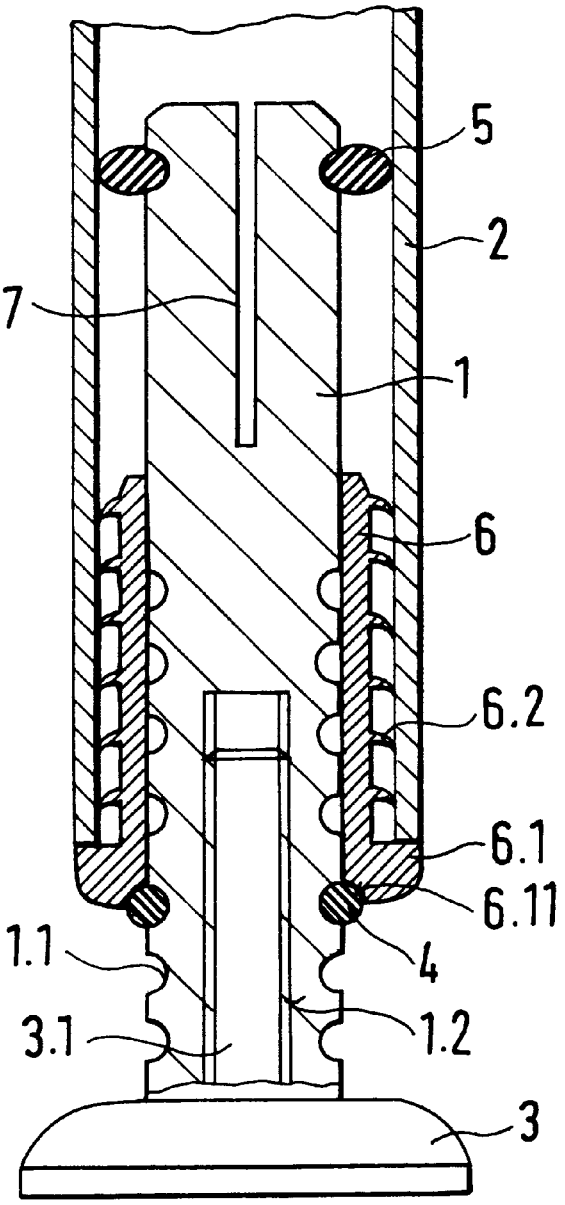
FIG. 1A is a longitudinal sectional view taken through a lower portion of a foot of a piece of furniture.

A vertical adjustment mechanism is disposed on the lower end of the foot of a piece of furniture (or of a support) and has an adjusting part 1 and a connector element 6, which is displaceably mounted on the adjusting part 1. On its external periphery, the adjusting part 1 has spaced apart annular grooves 1.1, which have a U-shaped cross-section, and in which a retaining ring 4 can be inserted under tension according to the desired vertical adjustment. The retaining ring 4, for example an O-ring formed from plastics material or rubber or a slotted metal ring, protrudes with an outer circumference beyond the external periphery of the adjusting part 1 and is at least partially gripped and clamped in position by a lower edge of the connector element 6 by means of an appropriate widened portion of the internal periphery of the connector element 6, so that the retaining ring 4 cannot slip from the groove 1.1 and provides a stable support for the connector element 6.

An external profile 2, for example a desirably processed wooden profile or a metal profile, is placed over the connector element 6 and is supported with its lower front edge on a collar at the lower edge of the connector element 6, which forms an abutment 6.1 for the external profile 2. The external periphery of the abutment 6.1 is adapted to the external periphery of the external profile 2, so that a flush transition is produced. The lower edge of the abutment 6.1 is rounded on its external surface. The visual impression can also be varied by means of such a shaping. To secure the connector element 6 on the internal periphery of the external profile 2, the portion of the connector element 6 protruding into the external profile 2 has a profiling 6.2, which has an annular configuration by way of example and extends inclined when viewed with respect to the direction of insertion, while it is orientated in opposition to the direction of insertion and prevents the connector element 6 from being removed from the external profile 2.

At its upper surface, the connector element 6 protrudes from a portion of the adjusting part 1, which has at least one additional groove 1.1 or a moulded bead or collar. A guard ring 5 is inserted in the additional groove 1.1 and is formed from rubber, plastics material or metal, so as to prevent the adjusting part 1 from accidentally being removed from the connector element 6, just like the bead or collar. The assembled unit, comprising the connector element 6 and the adjusting part 1, may thus be inserted into the external profile 2 as an integrated piece. As illustrated in FIG. 1A, the guard ring 5, or respectively the bead or collar, may have such an outer circumference that it is directly supported by its outer circumference on the internal periphery of the external profile 2, so that additional stability is achieved. To achieve a clamping effect, the portion of the adjusting part 1, protruding beyond the connector element 6 in the interior of the external profile 2, may have an elongated slot 7.

Figure 1B:
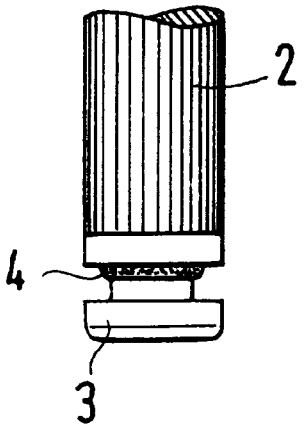
FIG. 1B illustrates an alternative embodiment for a lower end trim.

A bore 1.2, preferably a threaded bore, is provided in the lower surface of the adjusting part 1, and the end trim 3 can be inserted into the bore 1.2 with a securing pin 3.1 situated thereon. A fine adjustment is rendered possible with the end trim 3 by means of an adjustment in the threaded bore 1.2, so that there is compensation for uneven floors, for example. The end trim 3 may have various shapes, so as to vary also the visual impression, such as can be seen, for example, in FIG. 1B compared with FIG. 1A. The end trim 3 may also be configured as a castor.

With the described structure, visually quite different feet for a piece of furniture or supports can easily be provided without considerable costs by means of a uniform adjusting mechanism, so that a type of assembly is provided, for example, with various end trims 3, connector elements 6 and external profiles 2. In such case, one possible combination may reside in the fact that, for example for a narrow foot of a piece of furniture or support, the connector element 6 is completely omitted, and the external profile 2 is slipped directly over the adjusting part 1, whereby the widened portion 6.11 is then provided directly on the lower edge of the external profile 2.

We claim:

1. An adjustable foot for a piece of furniture, comprising: an internal adjusting part disposed on a lower end of the foot and having on an outer surface a plurality of annular grooves spaced apart from one another in an axial direction, a resilient ring insertable in the annular grooves, in an inserted position the ring protruding with an outer surface beyond an external periphery of the adjusting part, a sleeve element slidably guided over the adjusting part as far as the ring and having on a side facing the ring a widened portion clampingly gripping over the ring, the sleeve element being configured as a connector element and having an outer surface insertable within an internal diameter of an external profile and having an abutment on which the external profile is adapted to be supported in the inserted position, and an internal portion of the adjusting part protruding beyond the connector element and having at least one annular groove into which a guard ring is inserted which protrudes beyond an external periphery of the adjusting part.

2. A foot for a piece of furniture according to claim 1, wherein the adjusting part and the connector element is inserted into a lower end of the external profile, and the abutment comprises a stop collar having an external configuration with a shape adapted to correspond to the external profile.

3. A foot for a piece of furniture according to claim 2, wherein the outer surface of the portion of the connector element protruding into the external profile has a profiling for non-slip retention in the external profile.

4. A foot for a piece of furniture according to claim 3, wherein the guard ring is adapted to be supported with an external circumference on an internal periphery of the external profile.

5. A foot for a piece of furniture according to claim 4, wherein a receiving means for mounting an end trim is provided in a lower end face of the adjusting part.

6. A foot for a piece of furniture according to claim 5, wherein the receiving means comprises a bore extending in an axial direction, and the end trim has a securing pin securable in the bore.

7. A foot for a piece of furniture according to claim 6, wherein the adjusting part protrudes beyond the connector element with an internal portion, on which is a collar, the collar has a shape adapted to correspond to the internal periphery of the external profile, and the internal portion has at a free end at least one elongated slot which extends beyond the location of the collar.

8. A foot for a piece of furniture according to claim 1, wherein the outer surface of the portion of the connector element protruding into the external profile has a profiling for non-slip retention in the external profile.

9. A foot for a piece of furniture according to claim 1, wherein the guard ring is adapted to be supported with an external circumference on an internal periphery of the external profile.

10. A foot for a piece of furniture according to claim 1, wherein a receiving means for mounting an end trim is provided in a lower end face of the adjusting part.

11. A foot for a piece of furniture according to claim 10, wherein the receiving means comprises a bore extending in an axial direction, and the end trim has a securing pin securable in the bore.

12. An adjustable foot for a piece of furniture, comprising: an internal adjusting part disposed on a lower end of the foot and having on an outer surface a plurality of annular grooves spaced apart from one another in an axial direction, a resilient ring insertable in the annular grooves, in an inserted position the ring protruding with an outer surface beyond an external periphery of the adjusting part, a sleeve element slidably guided over the adjusting part as far as the ring and having on a side facing the ring a widened portion clampingly gripping over the ring, the sleeve element being configured as a connector element and having an outer surface insertable within an internal diameter of an external profile and having an abutment on which the external profile is adapted to be supported in the inserted position, the adjusting part protruding beyond the connector element with an internal portion, on which is a collar, the collar having a shape adapted to correspond to the internal periphery of the external profile, and the internal portion having at a free end at least one elongated slot which extends beyond the location of the collar.

* * * * *